United States Patent [19]

Bursk

[11] Patent Number: 4,662,112

[45] Date of Patent: May 5, 1987

[54] DOOR FRAME AND ASSEMBLY METHOD THEREFOR

[75] Inventor: William M. Bursk, Middletown, Ohio

[73] Assignee: Pease Industries, Inc., Fairfield, Ohio

[21] Appl. No.: 848,107

[22] Filed: Apr. 4, 1986

[51] Int. Cl.[4] ..... E06B 1/08

[52] U.S. Cl. ..... 49/380; 49/504

[58] Field of Search ..... 49/380, 505, 504; 52/212

[56] References Cited

U.S. PATENT DOCUMENTS 680,015 8/1901 Bachus ..... 49/505 X 1,855,470 4/1932 Bilton ..... 52/212

*Primary Examiner*—Kenneth Downey

*Attorney, Agent, or Firm*—Biebel, French & Nauman

[57] ABSTRACT

A prefabricated door assembly for insertion in a door opening in a wall of predetermined thickness comprises side and head jambs of a width less than the wall thickness, and the frame is completed by extender casings each comprising a molding which is butt jointed to the outer surface of an extender piece that has its opposite edge butt jointed to its complementary jamb to complete a frame assembly of the proper width to fit the door opening with the molding pieces overlying the junction between the extender pieces and the wall. These features provide significant savings in the cost of materials and also in the space required for shipping the prefabricated base frame assemblies prior to addition of the extender casings thereto.

10 Claims, 14 Drawing Figures

DOOR FRAME AND ASSEMBLY METHOD THEREFOR

BACKGROUND OF THE INVENTION

This invention relates to the field of prefabricated door frames. Such door frames are customarily assembled by a manufacturer and shipped intact to a builder's supply store or other sales outlet. These door frames must fit a wide range of wall thicknesses which may vary from four and nine-sixteenth inches when the studding is made of 2×4's to something in excess of six and one-half inches for 2×6 studding, and sometimes considerably more, depending upon the climate of the locality.

It has been the past commercial practice to supply prefabricated door frames in a size which is at least of the proper size to fit the minimum four and nine-sixteenths inch wall thickness, to which other pieces can be added for thicker walls, or unitary door jambs may be used which are made from the wider stock necessary to fit thicker walls. Prefabricated door frames at best involve substantial shipping cost, because such frames cannot be stacked inside each other, and since they thus enclose a substantial volume of air, they occupy correspondingly substantial volume in a truck trailer. The shipper must therefore pay for transporting the empty space inside of each such prefabricated door frame.

It is therefore apparent that there is a need to provide prefabricated door frames which may be stacked more compactly and which readily accommodate a variety of wall thicknesses.

SUMMARY OF THE INVENTION

This invention provides door frame assemblies characterized by a dimension in the wall thickness direction which is less than the minimum anticipated thickness of the wall. This dimensional difference is accommodated by providing door frame extenders which are separately shipped and installed.

The preassembled door frame assembly of the invention comprises conventional lock, hinge and head jambs and a sill which are perpendicularly joined to define a rectangular structure. The jambs each comprise the usual wall-engaging outer surface and an inner surface configured to support and define a closed position for a door. The jambs are of identical cross section, except for the appropriate mortises for hinges and a lock, but they differ from the conventional jambs by being deliberately made from board stock which is significantly less wide than the minimum width of a conventional wall in which they are to be installed.

More specifically, where that minimum wall width is four and nine-sixteenths inches for a wall composed of 2×4 studding and dry wall, the preferred width for the jambs of the invention is only three and seven-sixteenths inches, thus making it possible to start with board stock which is correspondingly less expensive. Further, since these jambs are approximately 25% smaller in width than the minimum size of conventional jamb, prefabricated frames made from such jambs offer approximately the same 25% saving in shipping space over frames made from conventional jambs of the minimum width.

The finished width of the jambs composing a door frame in accordance with the invention is determined by the thickness of the wall in which the frame is to be mounted, and the additional jamb width needed for that installation is provided by extender casings which are added to the prefabricated frame before it is installed. These extender casings, however, include extender pieces of substantially thinner board stock than the conventional jamb stock, but instead of being of only enough width to increase the jamb width to equal the thickness of the wall, they are made sufficiently wider to project beyond the wall into space normally occupied by the brick mold or other molding conventionally used to cover the joint between the door frame and the siding which forms the outside of the wall. As a result, the invention makes it possible to use molding of a substantially lesser width than is conventional, with this molding being butt jointed to the side of the frame extender pieces instead of overlapping the edges of the jambs as in the conventional construction.

This invention further provides a method of assembling a door frame comprising the steps of assembling a head jamb and sill perpendicularly between the ends of a pair of parallel and substantially equal length side jambs to define a door frame assembly, placing the door frame assembly snugly within a jig having a rectangular opening therein, placing door frame extenders inside the rectangular opening and in contact with the jambs, and fastening the extenders to the jambs so as to extend forwardly therefrom while being supported sidewardly thereby.

It is therefore a object of this invention to provide a door frame assembly which may be packed more compactly for shipment.

It is another object of this invention to provide a door jamb and a mating door frame extender which enable more efficient prefabrication of a door frame.

Yet another object of the invention is to provide an improved method of assembling a door frame.

Other objects and advantages of the invention will be apparent from the following description, the accompanying drawings and the appended claims.

DESCRIPTION OF THE PREFERRED EMBODIMENT

Figure 1:
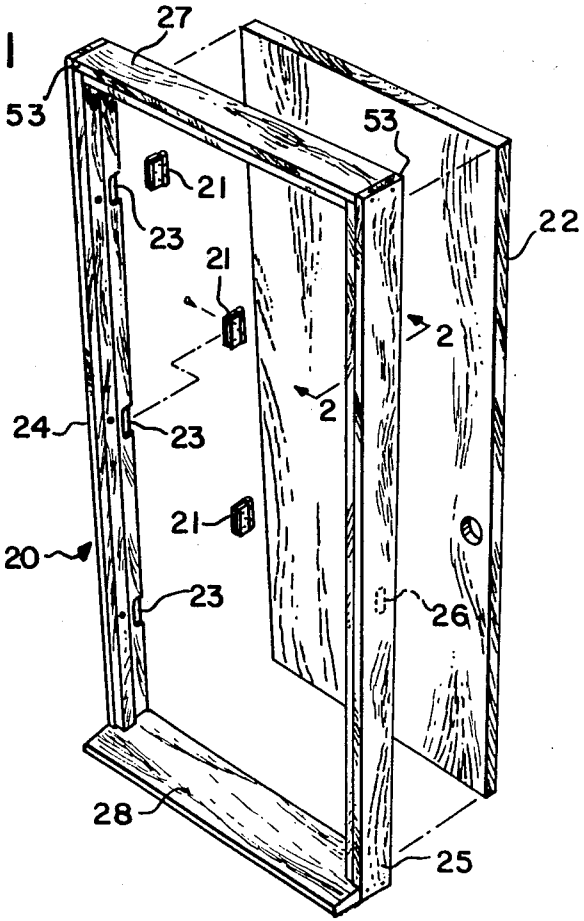
FIG. 1 is a perspective drawing of a door frame assembly in accordance with the invention.

FIG. 1 illustrates a door frame assembly 20 as prefabricated and ready for shipment to a builder's supply store. In the illustrated configuration, door frame 20 is provided with a door 22 which is shipped as part of the door frame assembly. Door 22 is attached to door frame assembly 20 by means of a set of hinges 21 which are set into mortises 23 in hinge jamb 24. The remainder of door frame assembly 20 comprises the lock jamb 25 provided with a lock mortise 26, and a head jamb 27 and sill 28 which perpendicularly join jambs 24 and 25 at the upper and lower ends thereof to complete the rectangular enclosure for door 22.

Figure 3:
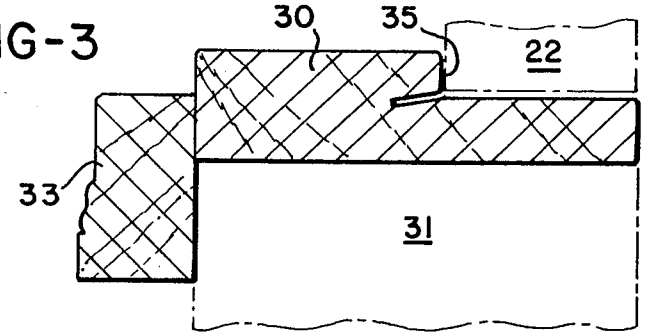
FIG. 3 is a cross section similar to FIG. 2 showing a conventional door frame.

Understanding of the advantages provided by the present invention will be facilitated by the illustration in FIG. 3 of a typical conventional door jamb 30 of the proper size to fit a wall 31 of the conventional minimum width of four and nine-sixteenths inches, together with brick mold 33 of the conventional size. This jamb 30 was necessarily milled from board stock of the four and nine-sixteenths inches width and the full thickness of that part of the jamb which is on the outside of the door and terminates with the shoulder 35 which forms the stop for the door in closed position. The molding 33 overlaps a portion of the end of this thick part of the jamb, leaving a shoulder 36 which may serve as a stop for a screen or storm door.

Figure 2:
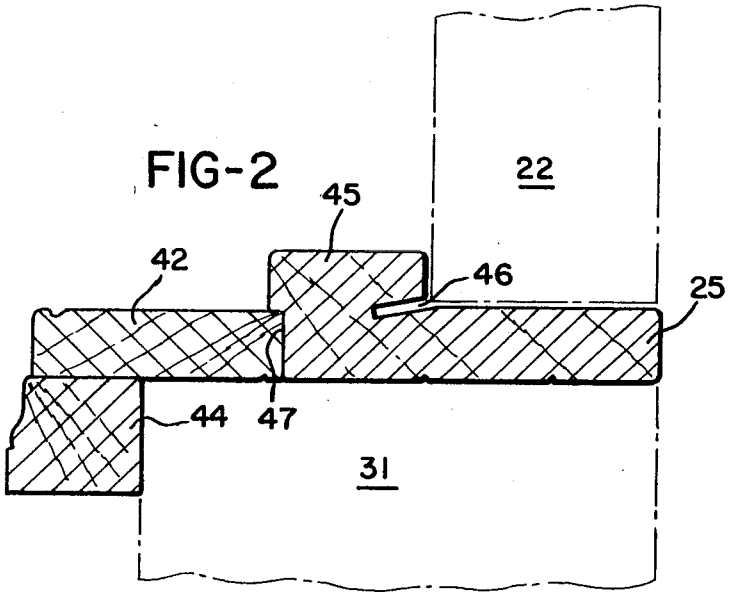
FIG. 2 is a cross sectional view of a door frame installation in accordance with the invention, taken as indicated by the line 2—2 of FIG. 1.

All three of the jambs 24, 25 and 27 of the invention have a common cross section shown in FIG. 3, which also illustrates a typical permanent installation wherein the frame fits against a wall 31 after having been completed by addition thereto of an extender casing 40 consisting of an extender piece 42 and molding 44. As shown in FIG. 2, the jamb is milled from board stock of the same thickness as the jamb 30 in FIG. 3 to provide a portion of sufficient thickness to constitute the door stop portion 45, but of a width which is just sufficient to provide the stop 45 with sufficient width and strength and to provide the proper space inboard of this stop to accommodate the thickness of the door 22, as illustrated in phantom lines in FIG. 2. On this factor, a practical consideration is that the minimum thickness of the stop portion 45 should be sufficient to accommodate the band portion of a two-piece frame mounting screen of the type shown in Johnsson U.S. Pat. No. 3,667,338 or White U.S. Pat. No. 4,486,134.

It has been found in the practice of the invention that these requirements can be met if the jamb is milled from stock three and seven-sixteenths inches wide and one and seven-thirty second inches thick, so that after milling, the stop portion 45 will be one and three-eighths inches wide on its exposed side, leaving two and one-sixteenth inches of space for the door along the resulting narrower section of the jamb. Such board stock is readily available at a significantly lower cost than the board stock necessary for the production of the conventional jamb shown in FIG. 3.

The slot 46 in FIG. 2 is for the reception of the barbed fin used conventionally for mounting magnetic weather stripping (not shown) in a door frame. The rabbet 47 is for the purpose of facilitating and concealing the joint between the extender piece 42 and the jamb.

The extender piece 42 is provided in accordance with the invention in several widths selected so that when one of these pieces is added to a jamb, it will result in a total jamb width equal to a common wall thickness plus the thickness of the brick mold 44 or other molding to be used therewith. As described in more detail hereinafter, before the prefabricated frame is installed, extender casings are incorporated therewith to form an essentially unitary structure, by means of corrugated fasteners 48 or other like means driven into the adjoining surfaces of the two parts 42 and 44 from the outside of the frame, namely the side which will abut the wall and be concealed.

Figure 4:
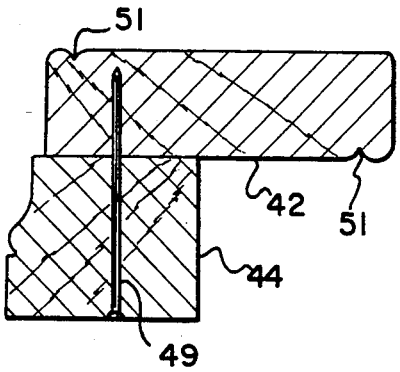
FIG. 4 is an enlarged cross sectional view of a casing extender taken on the same line as in FIG. 2.

In the practice of the invention, the molding 44 is fastened to the extender 42 to complete the extender casing before it is incorporated with the jamb. As illustrated in FIGS. 3 and 4, the molding 44 is in the configuration of the larger part of conventional brick mold 33, with its width being such that when it is secured to the side of the extender 42, they will approximately equal the width of conventional brick mold.

It is the proposed practice of the invention to supply extender pieces 42 in three widths, preferably two and one-eighth inches, two and three-quarters inches and four and one-eighth inches. When an extender of each of those widths is incorporated with a jamb molding of the proper thickness, the resulting composite jamb will be of precisely the right width for incorporating with a wall of a common conventional thickness, namely four and nine-sixteenths inches for a wall comprising $2\times4$ studding and dry wall, five and three-sixteenths inches for a wall comprising $2\times4$ studding and plaster, and six and nine-sixteenths inches for a wall comprising $2\times6$ studding and dry wall.

The combination of a jamb of the configuration of the invention with an extender 40 thus provides substantial economy from the standpoint of the cost of the lumber. Thus as already noted, the jamb itself is significantly less expensive than a conventional jamb which will fit a wall of the minimum common thickness, and since the molding 44 is milled from stock only approximately one-half as wide as the stock for conventional brick mold, that provides a further corresponding saving. More specifically, the jamb stock and the extender piece stock to produce a frame for a wall of minimum thickness are together substantially less expensive than conventional jamb stock for the same purpose. In addition, since the invention uses brick mold of little more than half the width of conventional brick mold, that provides a still further saving in material cost.

Figure 11:
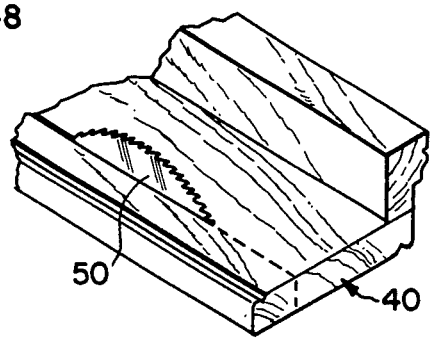
FIG. 11 illustrates the ripping of a door frame extender.
Figure 9:
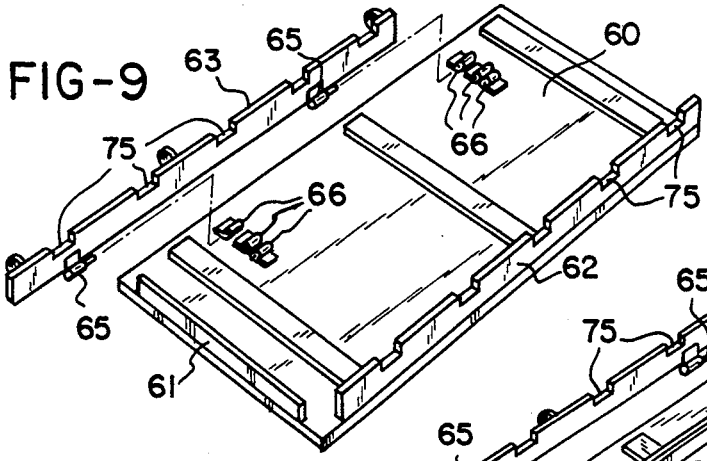
FIG. 9 is a perspective view of a jig for use in attaching door frame extender casings to a door frame assembly.

Since there are also many walls of thicknesses which do not match any of these three conventional sizes, the practice of the invention in connection with such walls simply requires that the extender piece be initially of the next larger size for that particular wall, and as illustrated by the saw blade 50 in FIG. 11, it is then ripped to the proper intermediate thickness. The decorative groove 51 is provided initially along one edge on both sides of the extender 42 so that the assembler of the casing can select the better of the two surfaces, if there is anything to choose between them, before combining it with the molding extender casings 40. Ripping of extender pieces 42 to match an intermediate thickness of wall does not affect this feature, because if so much has to be removed in ripping as to take with it the groove 51 on one side, that will be on the surface which faces the wall, and the absence of this groove will therefore not be apparent.

Figure 5:
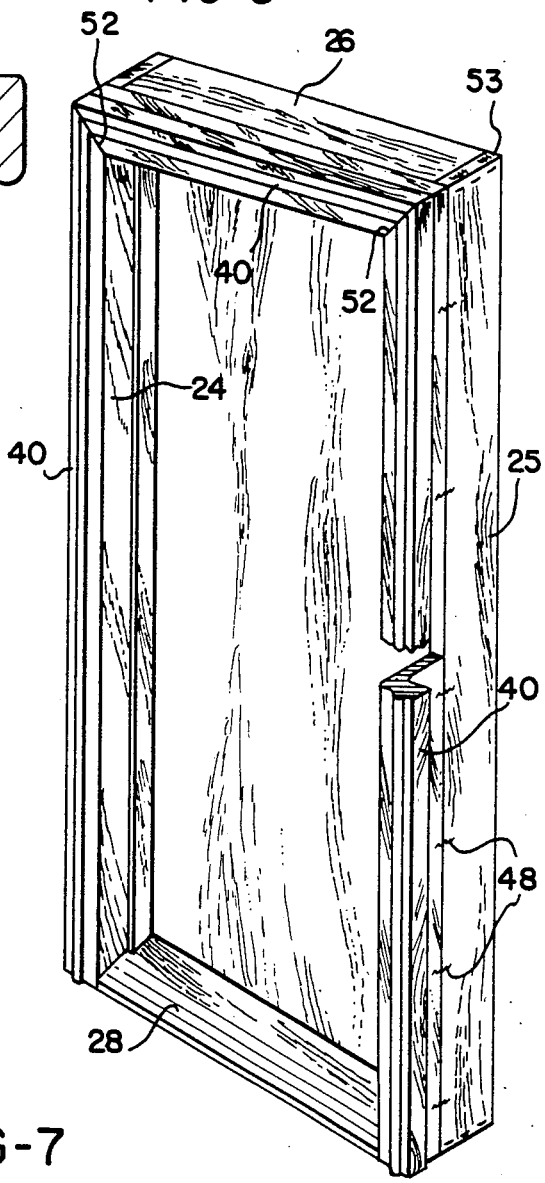
FIG. 5 is a perspective drawing of a completed door frame assembly of the invention.
Figure 6:
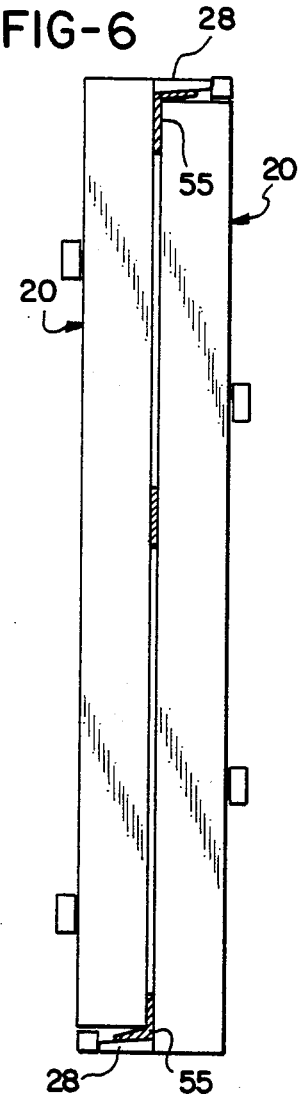
FIGS. 6 and 7 illustrates the stacking of door frame assemblies for shipment.

Since most moldings, like brick mold, have a contoured outer surface, it is necessary that the joints between the several lengths of molding around the frame be mitered, as indicated at 52 in FIG. 5. Further, since the preferred practice of the invention requires that the molding pieces 44 and extender pieces 42 be interconnected before they are attached to the prefabricated frame, the ends of the extender pieces will similarly be mitered. However, the three jamb pieces in each frame can be butt jointed, as indicated at 53 in FIG. 1.

Figure 7:
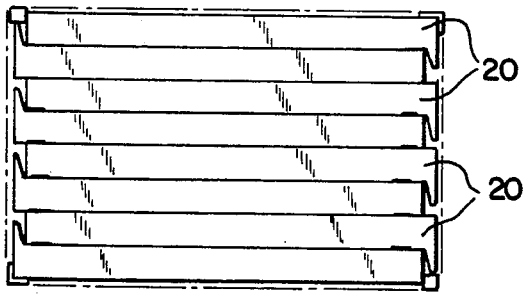
Figure 8:
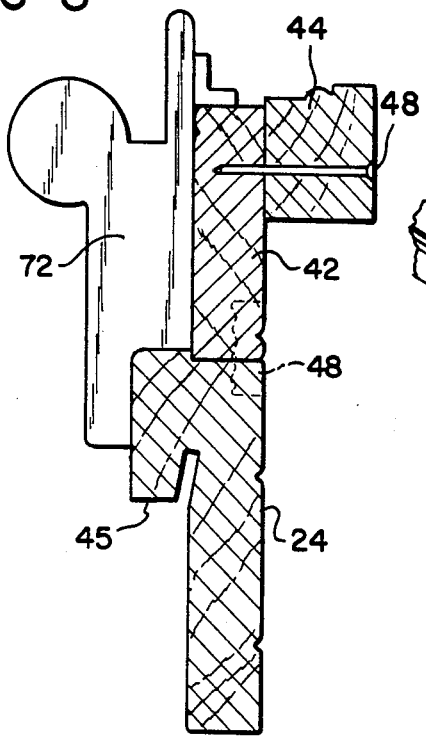
FIG. 8 is a cross sectional view illustrating the attachment of a door frame extender to a door jamb.

The basic door frame of the invention as shown in FIG. 1 is especially adapted for stacking in pairs for shipment after preassembly by the original manufacturer. Thus as illustrated in FIG. 7, two of these door frame assemblies 20 readily interfit with their sills 28 at opposite ends of the assembled pair. Inserts 55 of corrugated board or the like may be used as shown in FIG. 7 to protect the sills, and the assembled pair may be tied together by any suitable strapping, or may be assembled with additional pairs as shown in FIG. 8.

In this way, the basic frames of the invention of the dimensions described above provide a saving of at least about 25% of the space which would be required by frames of the minimum width to fit a wall of the conventional minimum thickness, and correspondingly greater savings over frames made from wider jamb stock. The extender and molding pieces 42 and 44 may be supplied as individual pieces, or as extender casing sub-assemblies, which can be set into the spaces within assembled pairs of prefabricated base frames.

FIGS. 10–14 illustrate the final assembly operations for completing the frame shown in FIG. 5 by the addition of the appropriate extender casings 40 to the basic frame shown in FIG. 1. These operations are carried out with the aid of a jig assembly which comprises a base 60, a pair of fixed guides 61 and 62 mounted on one end and one side of the base 60, and an adjustable guide 63. The adjustability of guide 63 is to accommodate frames of different widths in accordance with the width of the door therein, and adjustable mountings for the guide 63 are provided by male hinge members 65 on the guide and three spaced and aligned pairs of complementary female hinge members 66 on the base 60.

Figure 10:
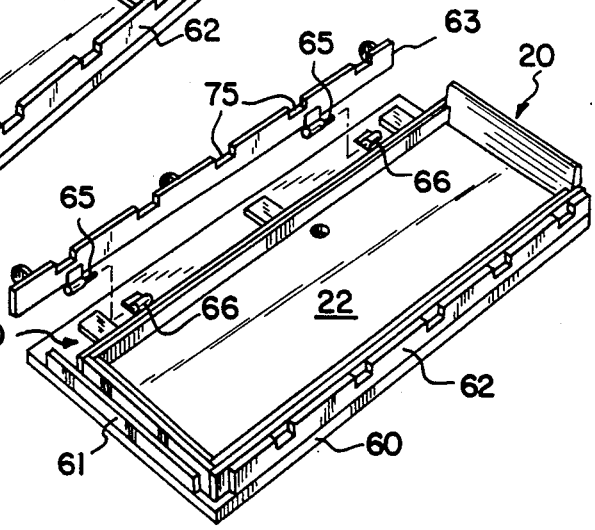
FIG. 10 is a perspective view showing a door frame assembly poisitioned in the jig of FIG. 9.

The first step in final assembly is the placement of a basic door frame assembly 20 against fixed guides 62–63, as illustrated in FIG. 10. The adjustable guide 63 is then mounted in position by insertion of its hinge members 65 in the proper pair of aligned hinge members 66 on the base 60.

Figure 12:
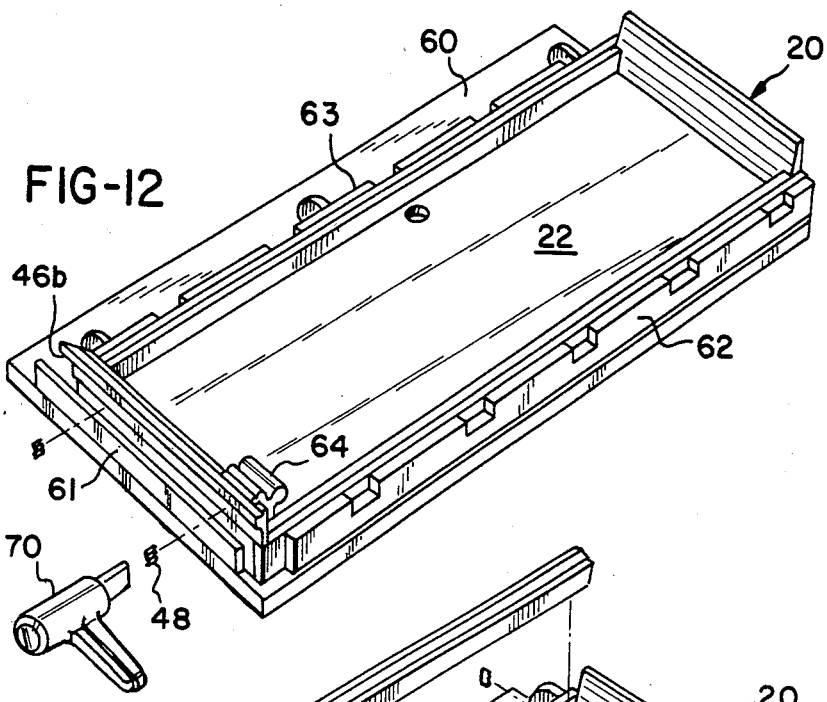
FIGS. 12–14 illustrate steps in attaching extender casings to a door frame assembly.
Figure 13:
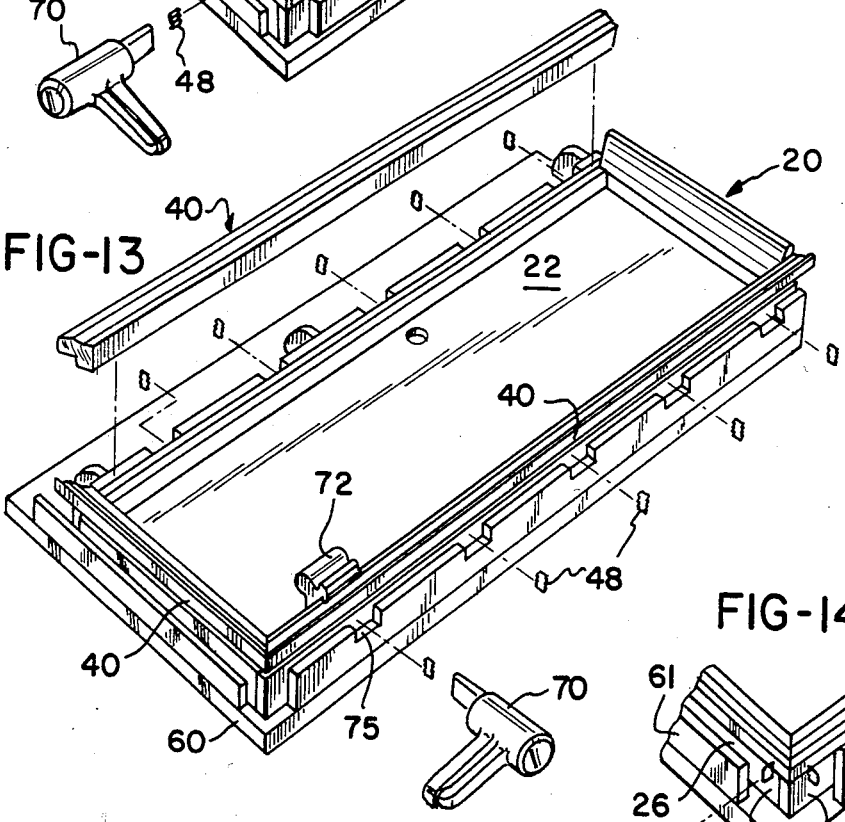

The extender casings 40 are miter cut to length before assembly with the other parts of the frame, and the first step in the final assembly is to locate the extender casing for the head jamb in proper position, with the inner edge of its extender piece 42 fitting into the rabbet 47 on the jamb 27, and to secure them together. For this purpose, it is convenient to use a corrugated nailer 70 to apply corrugated fasteners 48 with the aid of a hand-held assembly guide 72 of proper contour mating with the inner surfaces of the jamb and the extender casing, as illustrated in FIGS. 8 and 12, and the height of guide 62 is such that the junction of parts 27 and 42 to which fasteners are applied is above guide 62.

Figure 14:
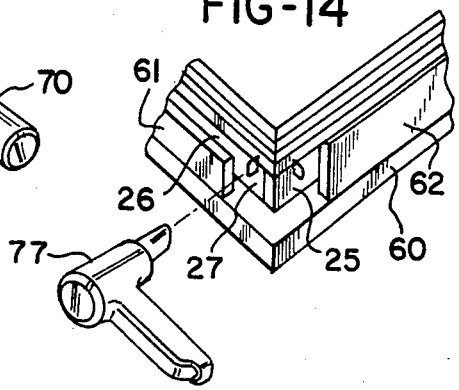

The two side extender casings are then set in place inside the adjustable guide 63 and fixed guide 61, which are proportioned to extend above the junction between the extender pieces 42 and the jambs, but which are provided with a series of notches 75 in their upper edges for the purpose of exposing those junctions. A corrugated nailer 70 is then used to apply corrugated fasteners through these notches 75 to complete the combination of each extender casing with its main jamb. Thereafter, the mitered corners are completed, as indicated in FIG. 14, by means of a staple gun 77 which applies staples of sufficient length to bridge interior of the mitered joint, and it will be noted that the guides 61–63 stop short of the corners of the base 60 in order to expose the corners of the frame for this purpose.

It should be noted that although the invention was initially developed for the purpose of saving space in the shipping of prefabricated door frame assemblies, it provides important advantages even if all of the parts are shipped in knocked down condition for assembly by the supplier to the ultimate user. This is due especially to the very significant savings in material cost over the prior practice.

While the article and method herein described constitute preferred embodiments of the invention, it is to be understood that the invention is not limited to this precise article and method, and that changes may be made therein without departing from the scope of the invention which is defined in the appended claims.

What is claimed is:

1. A prefabricated door frame assembly for insertion in a door opening in a wall of predetermined thickness, comprising:

(a) a pair of side jambs connected at their opposite ends to a head jamb and a sill to form a rectangular frame for receiving a door of predetermined height and width, (b) each of said jambs being of the same cross section which includes a portion of minimum thickness along one edge defining the space for receiving the door and a portion of greater thickness along the other edge defining a stop for the door in the closed position thereof, (c) each of said jambs being of a width which is less by a predetermined amount than said predetermined wall thickness, (d) an additional board butt-jointed to the edge of said stop-defining portion of each of said jambs and secured thereto by fastening means on the side thereof opposite said stop, and (e) each said additional board being of such width that the combined width of said board and said jamb is at least as great as said predetermined wall thickness.

2. A door frame assembly as defined in claim 1 wherein said jamb width is three and seven-sixteenths inches.

3. A door frame assembly as defined in claim 1 for installation in a wall of predetermined thickness greater than the width of said jambs wherein each said additional board is of such width that the combined width of said board and said jamb is greater than said predetermined thickness of said wall by a predetermined margin whereby said board will project beyond said wall, and further comprising a molding butt-jointed to the outer surface of said projecting portion of each said board to project therefrom into overlying relation with the junction of said board and said wall.

4. A door assembly as defined in claim 3 wherein each said additional board is of substantially the same thickness as said portion of minimum thickness of each of said jambs.

5. A door assembly as defined in claim 3 wherein said jambs are butt-jointed to each other and said additional boards are miter-jointed to each other.

6. A composite casing extender for a door frame comprising:

(a) an elongated wood extender piece of substantially greater width than thickness, (b) a similarly elongated wood molding piece having one edge thereof butt-joined to one side of said extender piece to project laterally therefrom, and (c) said casing having one end thereof miter-cut for producing a conformingly miter joint with a second similar extender casing.

7. A casing extender as defined in claim 6 for use to form a portion of a door frame for insertion in a door opening in a wall of predetermined thickness, said casing being characterized by the fact that the width of the portion of said extender piece extending from said molding to the opposite edge thereof is a predetermined fraction of the thickness of said wall.

8. The method of prefabricating a door frame assembly which comprises the steps of:

(a) joining the ends of a pair of side jambs with a head jamb and a sill to form a rectangular frame for receiving a door, (b) each of said jambs being of the same cross section which includes a portion of minimum thickness defining the space for receiving the door and a portion of greater thickness defining a stop for the door in the closed position, (c) assembling an extender casing for each of said jambs by forming a butt-joint between the inner edge of a molding piece and the side of an extender piece of rectangular section and substantially the same thickness as said jamb portion of minimum thickness, (d) securing the edge of each said extender piece spaced from said molding to said stop-defining portion of the related said jamb, and (e) securing the ends of extender casings together.

9. The method defined in claim 8 wherein said step (a) is carried out by butt-joining said jambs and said sill, and further comprising the step of mitering the ends of said extender casings to be joined together prior to said steps (d) and (e).

10. The method defined in claim 9 which includes the step of placing said frame, prior to said step (d), in a jig including guides proportioned to enclose said jambs and said extender pieces while leaving the junctions therebetween exposed at the corners and spaced positions along the sides thereof, and carrying out said steps (d) and (e) by applying thereto fastening means which bridge said exposed junctions.

* * * * *